US006018976A

United States Patent [19]

Wolf

[11] Patent Number: 6,018,976

[45] Date of Patent: Feb. 1, 2000

[54] PROCESS FOR TIGHTLY CLOSING A BORE IN A WORK PIECE MADE OF DUCTILE MATERIAL

[75] Inventor: Markus Wolf, Kempten, Germany

[73] Assignee: Robert Bosch GmbH, Stuttgart, Germany

[21] Appl. No.: 09/168,958

[22] Filed: Oct. 9, 1998

[30] Foreign Application Priority Data

Oct. 23, 1997 [DE] Germany ..... 197 46 840

[51] Int. Cl.[7] ..... B21D 28/10

[52] U.S. Cl. ..... 72/327; 72/325; 72/335; 72/362

[58] Field of Search ..... 72/325, 335, 327, 72/326, 334, 479, 362, 340

[56] References Cited

U.S. PATENT DOCUMENTS 1,325,194 12/1919 Geist ..... 72/335
4,072,039 2/1978 Nakanishi ..... 72/335
5,263,353 11/1993 Bakermans ..... 72/335

FOREIGN PATENT DOCUMENTS 2 301 261 7/1974 Germany .
3333490 4/1985 Germany ..... 72/335
82230 5/1985 Japan ..... 72/335

*Primary Examiner*—Daniel C. Crane
*Attorney, Agent, or Firm*—Edwin E. Greigg; Ronald E. Greigg

[57] ABSTRACT

The process is characterized by means of successively executed displacements of material of a work piece into the inner bore diameter at different points of the mouth of a bore. The displacement of the material is executed by means of a die that can be moved at least approximately in the direction of the bore axis. The process for tightly closing a bore can preferably be used with work pieces comprised of ductile material, in particular an aluminum wrought alloy.

5 Claims, 1 Drawing Sheet

PROCESS FOR TIGHTLY CLOSING A BORE IN A WORK PIECE MADE OF DUCTILE MATERIAL

BACKGROUND OF THE INVENTION

The invention is based on a process for tightly closing a bore in a work piece made of ductile material.

A process of this kind has already been disclosed (DE-OS 2 301 261), in which the end section of a tube is compressed radially to the tube axis at four opposing points by a multi-part tool in order to close the inner cross section of the tube. This process is relatively simple to use with tubular work pieces, but it fails to function when the cross section to be closed exists as a bore in a solid tool.

OBJECT AND SUMMARY OF THE INVENTION

The process according to the invention has the advantage over the prior art that the side of the work piece from which the production of the bore is executed is also the side from which its closure is produced so that the process is simple to use in thick-walled or solid work pieces. Due to the successively executed displacement of the material at the different points of the bore mouth, material beads are produced in the bore that reduce the inner cross section and finally close the bore tight by overlapping or engaging with one another.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
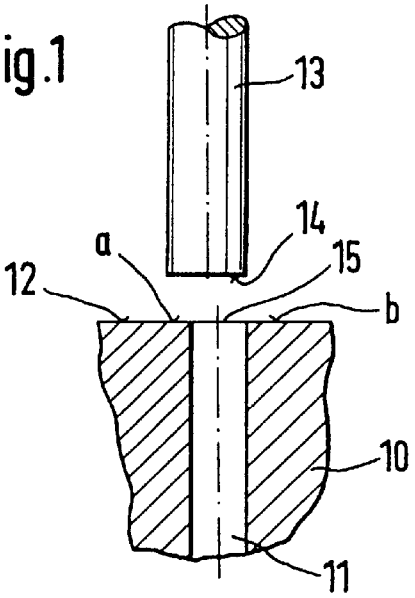
FIG. 1 shows a bore in an axial section, with a die in an initial position.

A solid or at least thick-walled work piece 10 comprised of ductile material, for example an aluminum wrought alloy, is provided with a bore 11 that has a circular cylindrical cross section, which extends with its longitudinal axis at right angles to an end face 12 of the work piece 10 (FIG. 1). Above the work piece 10, a die 13 is disposed, which has a circular cylindrical cross section and whose longitudinal axis is laterally offset in the plane of the drawing and runs parallel to the longitudinal axis of the bore 11. The die 13 has a larger diameter than the bore 11. The offset of the die 13 in relation to the bore 11 is dimensioned so that the defining edge of the die 13 that is disposed on the right in the drawing is preferably flush with the right defining edge of the bore 11.

Figure 2:
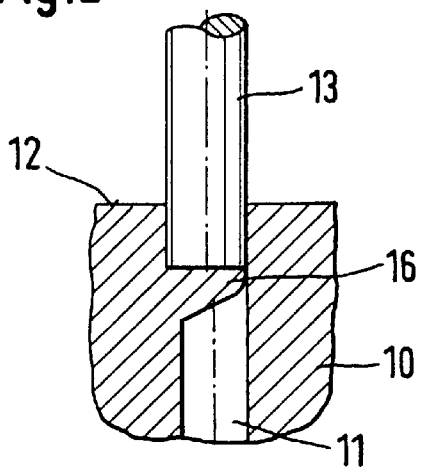
FIG. 2 shows the bore with a material bead produced with the first die stroke.

The die 13 can be moved in the direction of the work piece 10 through the use of a device that is not shown. A smooth end face 14 of the die 13, which extends at right angles to the longitudinal axis, strikes against the end face 12 of the work piece 10, in fact against a zone with a sickle-shaped outline that is indicated in FIG. 1 with point a of the bore mouth 15. In the further course of the die 13, which is moved downward with a sufficient degree of pressing force, the die displaces material of the work piece 10 into the inner bore cross section starting from the point a. By cold flowing, the material deformed by means of the die 13 forms a bead, which closes the bore 11 in the work piece 10 more or less depending on the die stroke, the diameter of the bore 11, and the diameter of the die 13 (FIG. 2).

Figure 3:
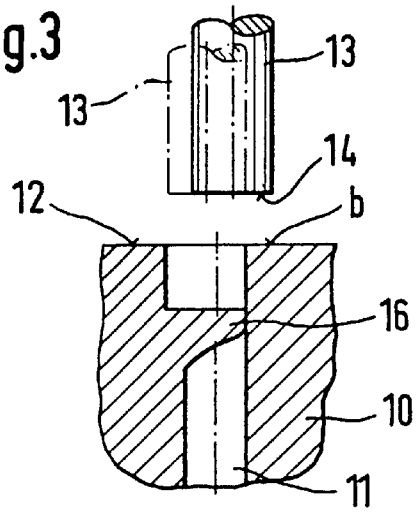
FIG. 3 shows the bore with the die withdrawn.
Figure 4:
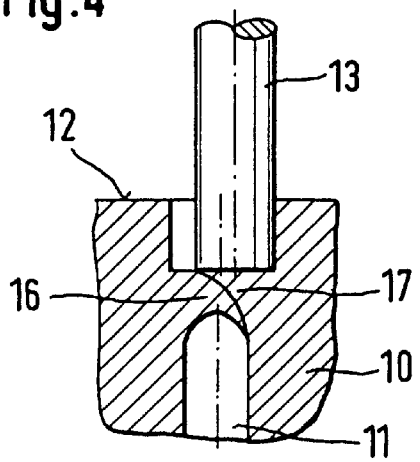
FIG. 4 shows the bore with a further material bead produced with the second die stroke.
Figure 5:
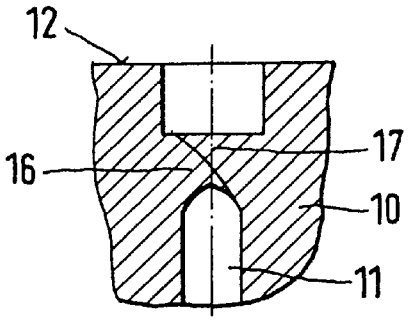
FIG. 5 shows the bore tightly closed by the two material beads engaged with each other.

In the subsequent process step, the die 13 is pulled back into its initial position (shown with dot-and-dash lines in FIG. 3) and then is moved lateral to the bore axis into an initial position for a second die stroke. This position of the die 13 is reproduced with solid lines in FIG. 3. When moved downward in the second stroke, the die 13, which is offset lateral to the bore axis in the plane of the drawing, strikes against a sickle-shaped zone of the bore mouth 15 described as point b, and penetrates into the work piece 10 with the same stroke depth as in the first stroke (FIG. 4). As a result, material is displaced on the side opposite from point a and forms a second material bead 17. This second material bead 17 displaces the first material bead 16 and/or overlaps with the first material bead 16 and, together with it, constitutes a barrier in the bore 11, which closes the bore in a fluid-tight and gas-tight manner. In a concluding return stroke of the die 13, the work piece 10 is released (FIG. 5).

The process is thus comprised in that the bore is tightly closed by means of successively produced displacements of material into the inner cross section of the bore 11, at least approximately in the direction of the bore axis, at different points a and b of the mouth 15 of the bore. In the example of the process described, the displacement of the material occurs at two opposing points a and b of the bore mouth 15. With larger bore cross sections and/or a comparatively smaller die cross section, the displacement of material can occur at more than two points of the bore mouth 15, wherein these points are preferably disposed distributed evenly around the bore mouth. Furthermore, the size of the material beads 16, 17 can also be influenced by means of an altered die stroke. Finally, the process can also be used with work pieces 10 whose end face 12 does not run at right angles to the longitudinal axis of the bore 11.

The process is not limited to the closure of bores 11 that have circular cylindrical cross sections. It can also be used to tightly close bores or openings with other cross sections. Correspondingly, the engagement of the die 13 at different points of the mouth of the bore or the opening must be chosen in such a way that the material beads produced achieve a secure closure. Also, dies can be used that have a cross sectional shape adapted to the cross section of the bore or the opening.

The foregoing relates to preferred exemplary embodiments of the invention, it being understood that other variants and embodiments thereof are possible within the spirit and scope of the invention, the latter being defined by the appended claims.

We claim:

1. A process for tightly closing an inner bore (11) in a work piece (10) comprising a ductile material, the steps comprising positioning an end of a male die (13) upon a mouth (15) of the inner bore of the work piece at a position (a) with an axis of said die (13) off-set with an axis of the bore, positively moving the male die in an axial direction of the inner bore (11) thereby forcing a first portion of the inner bore of the ductile material across a diameter of said bore, removing said die (13) from the bore and moving said die diametrically so that the axis of the die is off-set with respect to the axis of the bore (11) with a portion of the end of the die juxtaposed a position (b) of the mouth, positively moving the male die for a second time in an axial direction of said inner bore (11) thereby forcing a second portion of said inner bore of said ductile material across a portion of said bore (11) complemented with said first portion, and removing the die from the bore, whereby said first and second portions of said inner bore that are displaced by said die closes said inner bore (11).

2. The process according to claim 1, in which the die (13) executes strokes of the same depth at different points (a, b) of the bore mouth (15).

3. The process according to claim 1, in which the material is displaced with a die (13) of a circular cylindrical cross section.

4. The process according to claim 1, in which the material is displaced at the different points (a, b) of the bore mouth (15) when the die (13) is shifted laterally in relation to the bore axis and moved axially along the bore.

5. The process according to claim 4, in which the material is displaced at two opposing points (a, b) of the bore mouth (15).

* * * * *